US006009810A

United States Patent [19]

Walsh

[11] Patent Number: 6,009,810

[45] Date of Patent: Jan. 4, 2000

[54] AIRBAG PROPELLANT

[75] Inventor: Christine Marie Walsh, Pomfret, Md.

[73] Assignee: The United States of America as represented by the Secretary of the Navy, Washington, D.C.

[21] Appl. No.: 09/111,518

[22] Filed: Jul. 8, 1998

[51] Int. Cl.[7] ..... C06B 45/00

[52] U.S. Cl. ..... 102/288; 280/741; 149/19.6; 149/19.91; 149/92

[58] Field of Search ..... 280/741; 149/19.91, 149/19.6, 92

[56] References Cited

U.S. PATENT DOCUMENTS

| | | | |
|---|---|---|---|
| H969 | 10/1991 | Yee | 149/19.91 |
| 3,914,141 | 10/1975 | Sayles | 149/19.3 |
| 3,953,258 | 4/1976 | Sayles | 149/19.3 |
| 4,100,224 | 7/1978 | Hess et al. | 525/166 |
| 4,283,237 | 8/1981 | Reed, Jr. et al. . | |
| 4,428,786 | 1/1984 | Arni | 149/21 |
| 5,074,937 | 12/1991 | Stott et al. | 149/19.91 |
| 5,290,857 | 3/1994 | Ashida et al. . | |
| 5,602,361 | 2/1997 | Hamilton et al. . | |
| 5,616,883 | 4/1997 | Hamilton et al. . | |
| 5,654,357 | 8/1997 | Menashi et al. | 524/495 |
| 5,681,904 | 10/1997 | Manzara | 525/404 |

*Primary Examiner*—Edward A. Miller
*Attorney, Agent, or Firm*—John Forrest; Roger D. Johnson

[57] ABSTRACT

A plasticizer-free propellant for inflating passenger airbags in vehicles comprising from about 78 to about 90 weight percent of cyclotrimethylenetrinitramine (RDX) and from about 10 to about 22 weight percent of a plasticizer-free polymer binder formed by curing a mixture of a polyoctenamer and a polymer comprising an acrylate polymer or a methacrylate polymer having a glass transition temperature of −30° C. or lower and 0.01 to 5 weight percent based on the total amount of the monomers, of a crosslinking monomer having two or more double bonds of substantially the same reactivity in the molecule or one double bond and a crosslinking functional group such as an epoxide ring, a hydroxyl group, or a carbonyl group. This propellant is useful in hybrid inflators for air/safety bags in vehicles.

42 Claims, 1 Drawing Sheet

PRIOR ART

AIRBAG PROPELLANT

BACKGROUND

This invention relates to the field of automobile inflatable safety systems and more particularly to propellants for hybrid inflators.

U.S. Pat. Nos. 5,602,361 and 5,616,883 describe hybrid inflators for automobile inflatable safety systems which mix gases generated by a burning gun-type solid propellant with a compressed mixture of an inert gas (e.g., argon) and oxygen and use the resulting mixture to inflate an air/safety bag. Carbon monoxide (CO) and hydrogen ($H_2$) in the propellant gases are converted by the oxygen to carbon dioxide ($CO_2$) and water ($H_2O$). The burning of the gun-type propellant and the oxidation of the $CO_2$ and $H_2$ provide heat which drives the expansion of the compressed gases to inflate the bag. The gases which inflate the bag are nontoxic and do not obstruct the view of the people in the vehicle. The hybrid inflator system is compact, efficient, and safe.

A critical requirement of any air/safety bag system is that it must have a long shelf life. In other words, years later the system should work with no decrease in efficiency. U.S. Pat. Nos. 5,602,361 and 5,616,883 disclose the use of conventional solid gun-type propellants in the hybrid inflator systems. These conventional gun-type propellants contain low molecular weight plasticizers which over time migrate in the propellants, changing their properties. It would be desirable to provide a solid propellant with more consistent long term properties and thus a longer shelf life for the hybrid inflators. Such new propellants must not produce gases that are toxic or which obstruct the view of occupants of the vehicle. The new propellant must also have good, strong physical properties which make them suitable for use in a vehicle where they will be subject to many physical bumps and shocks.

SUMMARY

Accordingly, an object of this invention is to provide a new propellant.

Another object of this invention is to provide a new propellant for use in hybrid inflator systems for air/safety bags.

A further object of this invention is to provide a new propellant whose performance characteristics remain consistent over a long period of time.

Still another object of this invention is to provide a plasticizer-free propellant for use in inflator systems for air/safety bags.

These and other objects of this invention are accomplished by providing a plasticizer-free propellant composition comprising:

A. from 78 to 90 weight percent cyclotrimethylenetrinitramine (RDX); and

B. from 10 to 22 weight percent of a plasticizer-free polymer binder formed by curing a mixture of (1) from about 3 to about 6 weight percent of an polyoctenamer, and (2) from about 94 to about 97 weight percent of an acrylate polymer formed by polymerizing a noncrosslinking monomer of the formula $C(R_1)H{=}CHC(O)OR_2$ when $R_1$ is hydrogen, methyl, or mixtures thereof and $R_2$ is an alkyl group of from 2 to 8 carbon atoms or a mixture of alkyl groups of from 2 to 8 carbon atoms with a crosslinking monomer having two or more double bonds of substantially the same reactivity in the molecule or one double bond and a crosslinking functional group such as an epoxide ring, hydroxyl group, or carbonyl group, wherein the crosslinking monomer comprises from 0.01 to 5 weight percent of the monomers with the noncrosslinking monomer comprising the remainder, and wherein the acrylate polymer has a glass transition temperature of −30° C. or lower.

These objects are further achieved by using the plasticizer-free propellant composition in a hybrid inflator for air/safety bags.

BRIEF DESCRIPTION OF THE DRAWINGS

The drawings are prior art drawings which are copies from U.S. Pat. No. 5,616,883 and which illustrate a typical hybrid inflator for an automotive inflatable safety system in which the propellants of the present invention may be used. Specifically.

DESCRIPTION

Figure 2A:
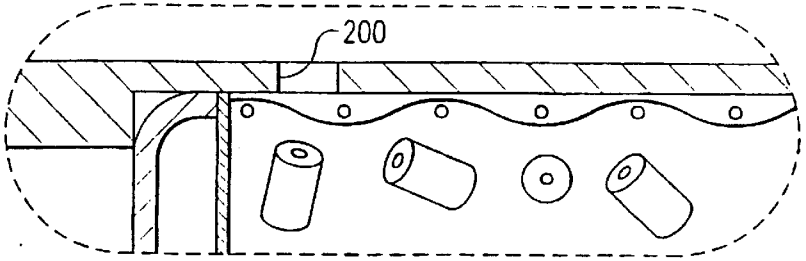
FIG. 2A PRIOR ART
FIG. 2 is a longitudinal cross-sectional view of a hybrid inflator.

The present invention provides plasticizer-free solid propellant compositions which are used as substitutes for the gun-type propellants used in hybrid inflators for air/safety bag systems for vehicles. The plasticizer-free propellant of this invention is designed to have a long shelf life during which the propellant remains physically strong, insensitive, safe, and fully operative. A key feature of the plasticizer-free propellant is that it is flexible and yet free of low molecular weight plasticizers which migrate and change the properties of propellants. This is achieved by combining cyclotrimethylenetrinitramine (RDX) and a plasticizer-free polymer binder that is prepared by curing a mixture of a polyoctenamer and an acrylate polymer or methacrylate polymer having a glass transition temperature of −30° C. or lower.

The plasticizer-free propellant of the present invention comprises cyclotrimethylenetrinitramine (RDX) particles in a plasticizer-free binder. The plasticizer-free propellant comprises preferably from 78 to 90, more preferably from 80 to 85, and still more preferably from 82 to 84 weight percent of RDX with the plasticizer-free binder comprising the remainder of the propellant. In other words the plasticizer-free binder will preferably comprise from 22 to 10, more preferably from 20 to 15, and still more preferably from 18 to 16 weight percent of the propellant. There has to be enough binder to sufficiently coat the RDX particles, but not so much as to reduce the performance of the propellant.

The binder is formed by curing a mixture comprising preferably from about 3 to about 6 and more preferably from 4 to 5 weight percent of the polyoctenamer with the remainder of the binder mixture (preferably from about 97 to about 94 and more preferably from 96 to 95 weight percent) being an acrylate or methacrylate polymer having a glass transition temperature of preferably −30° C. or lower and more preferable from −40° C. to −70° C. The curing process produces crosslinking between the acrylate or methacrylate polymer chains which improves the physical properties of the plasticizer-free propellant composition.

The polyoctenamer functions initially as a processing aid which with a solvent such as tetrahydrofuran (THF) is needed so the propellant composition can be extruded. Unlike the solvent, which is removed, the polyoctenamer remains to be an important part of the final plasticizer-free propellant composition. The polyoctenamer contributes to the flexibility and good physical properties of the final plasticizer-free propellant composition. The polyoctenamer used in the preferred embodiment is available under the Tradename of Vestenamer 6213 (Creanova Inc., a Huls Group Company). Polyoctenamers are produced by polymerization of octene. The polyoctenamer preferably has a medium trans content and more preferably has a trans content of about 60 percent. The polyoctenamer preferably has a melting point of from about 28 to about 38° C.

The acrylate or methacrylate polymer is formed by polymerizing noncrosslinking monomers that are alkyl acrylates, alkyl methacrylates, or mixtures thereof with preferably from 0.01 to 5 weight percent of crosslinking monomers having two or more double bonds of substantially the same reactivity in the molecule or one double bond and a crosslinking functional group which is preferably an epoxide ring, hydroxyl group, or carbonyl group, with the epoxide ring being most preferred. Suitable polymers for use in this invention are disclosed U.S. Pat. No. 5,290,857 which issued to Tadashi Ashida et al. on Mar. 1, 1994 and which is herein incorporated by reference in its entirety. Specifically, the rubbery seed polymers discussed at column 4, line 54 through column 5, line 23 of Ashida et al. may be used as the acrylate or methacrylate polymer in the present invention.

The alkyl acrylate and alkyl methacrylate monomers which may be used to produces the acrylate or methacrylate polymers used in this invention can be represented by the general formula $C(R_1)H{=}CHC(O)OR_2$ where R1 is hydrogen (—H) for alkyl acrylates, R1 is methyl ($—CH_3$) for alkyl methacrylates, and R2 is an alkyl group. $R_2$ is preferably an alkyl group of from 2 to 8 carbon atoms and more preferable an alkyl group of from 2 to 4 carbon atoms. Specific examples of preferred alkyl acrylate ($R_1$ is —H) monomers include ethyl acrylate, $CH_2{=}CHCOOCH_2CH_3$; n-propyl acrylate, $CH_2{=}CHCOOCH_2CH_2CH_3$; and n-butyl acrylate, $CH_2{=}CHCOOCH_2CH_2CH_2CH_3$. Other examples of preferred alkyl acrylate monomers include cyclohexyl acrylate and 2-ethylhexyl. Specific examples of preferred alkyl methacrylate (R1 is $—CH_3$) monomers include ethyl methacrylate, $CH(CH_3){=}CHCOOCH_2CH_3$; n-propyl methacrylate, $CH(CH_3){=}CHCOOCH_2CH_2CH_3$; and n-butyl methacrylate, $CH(CH_3){=}CHCOOCH_2CH_2CH_2CH_3$. The acrylate or methacrylate polymers comprise preferably from 0.01 to 5 and more preferably from 0.1 to 2 weight percent of crosslinking monomers having two or more double bonds of substantially the same reactivity in the molecule or one double bond and a crosslinking functional group such as an epoxide ring, hydroxyl group, or carbonyl group, with an epoxide ring being more preferred. Examples of crosslinking monomers include ethylene glycol diacrylate, ethylene glycol dimethacrylate, butylene glycol diacrylate, butylene glycol dimethacrylate, trimethylolpropane diacrylate, trimethylolpropane dimethacrylate, trimethylolpropane triacrylate, trimethylolpropane trimethacrylate, hexanediol diacrylate, hexanediol dimethacrylate, oligoethylene diacrylate, oligoethylene dimethacrylate, or mixtures thereof.

The polyacrylate and polymethacrylate polymers preferably have average molecular weights of 200,000 or greater to provide the propellant with good mechanical properties. Also, the polymers preferably have a density of 1.1 g/cm$^3$ or less in order that a high percentage of solids (RDX particles) can be incorporated. The polymers have a glass transition temperature of preferably less than −30° C. and as a result the propellant withstands rigorous thermal stability testing without propellant grain breakage. Finally, the polyacrylate and polymethacrylate polymers are preferably completely saturated after cross-linking is completed, resulting in a binder having good aging properties.

The cyclotrimethylenetrinitramine (RDX) particles are preferably small so that a uniform distribution of the RDX throughout the propellant binder is achieved. The RDX particle size is not critical and may be that generally used in propellants. The 5 to 7$\mu$ particles used in the examples worked well.

Example 1 illustrates a method for preparing the airbag propellant of this invention. The polyacrylate or polymethacrylate polymer and the processing aid (Vestenamer 6213) are softened by combining them with tetrahydrofuran (THF) under agitation. The resulting premix is then combined with the RDX, cure catalyst, and anti-oxidant and mixed until all the ingredients are thoroughly incorporated. Enough THF is then removed to allow the material to be extruded under pressure through a die or dies to form strands. The extrusion pressures required may be preferably from 3000 to 9000, more preferably from 6000 to 9000, and still more preferably from 7500 to 9000 psi. These strands are then cut to the required lengths.

The addition of the processing aid to the premix is critical. The propellant is difficult to mix and extremely difficult to extrude without it. The processing aid also drastically improves the strand integrity of the propellant, which facilitates easier handling during the cutting process. In the examples, Vestenamer 6213 was used as the processing aid. Vestenamer 6213 is a polyoctenamer with a medium trans content (TOR) of around 60 percent. Vestenamer 6213 has a density of 0.89 g/cm$^3$ and a melting point of 33±5° C. It is a solid below its melting point and a viscous liquid above its melting point. It has a rapid viscosity drop. "This polymer [Vestenamer 6213] is used practically exclusively as a blend component for other rubbers which gives rise to a number of highly favorable effects such as improving the plasticity in the mixing process, enhancing filler incorporation and dispersion and, thereby, lowering energy consumption and dump temperature . . . . The improved flowability by VESTENAMER leads to smoother extrudates, higher output and higher extrusion precision and also enables the processing of otherwise poorly extrudable compounds such as plasticizer-free compounds . . . " quoted from Struktol Company of America's Home Page (http:/www.struktol.com/) which is maintained by *RubberWorld Magazine's* Electronic Publishing Division. Other similar rubber processing aids may also be used. Specific examples of the hybrid inflators systems in which the propellants of this invention can be used are disclosed by Brian K. Hamilton and James L. Baglini in U.S. Pat. No. 5,602,361, titled "Hybrid inflator", which issue Feb. 11, 1997, hereby incorporated by reference in its entirety, and in U.S. Pat. No. 5,616,883, titled "Hybrid Inflator and Related Propellants", which issued Apr. 1, 1997, hereby incorporated by reference in its entirety. These patents are assigned to OEA, Inc., Aurora, Colo.

The following description of a typical hybrid inflator for an automotive inflatable safety system, in which the propellants of the present invention are preferably used as the propellant grains (90), is quoted form U.S. Pat. No. 5,616,883, column 4, line 39 through column 7, line 27.

Figure 1:
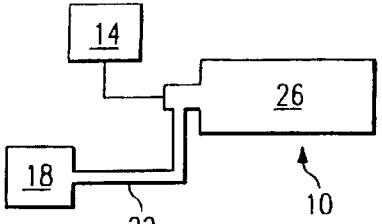
FIG. 1 is a schematic representation of an automotive inflatable safety system.

"One embodiment of an automotive inflatable safety system is generally illustrated in FIG. 1. The primary components of the inflatable safety system 10 include a detector 14, an inflator 26, and an air/safety bag 18. When the detector 14 senses a condition requiring expansion of the air/safety bag 18 (e.g., a predetermined deceleration), a signal is sent to the inflator 26 to release gases or other suitable fluids from the inflator 26 to the air/safety bag 18 via the conduit 22.

Figure 2:
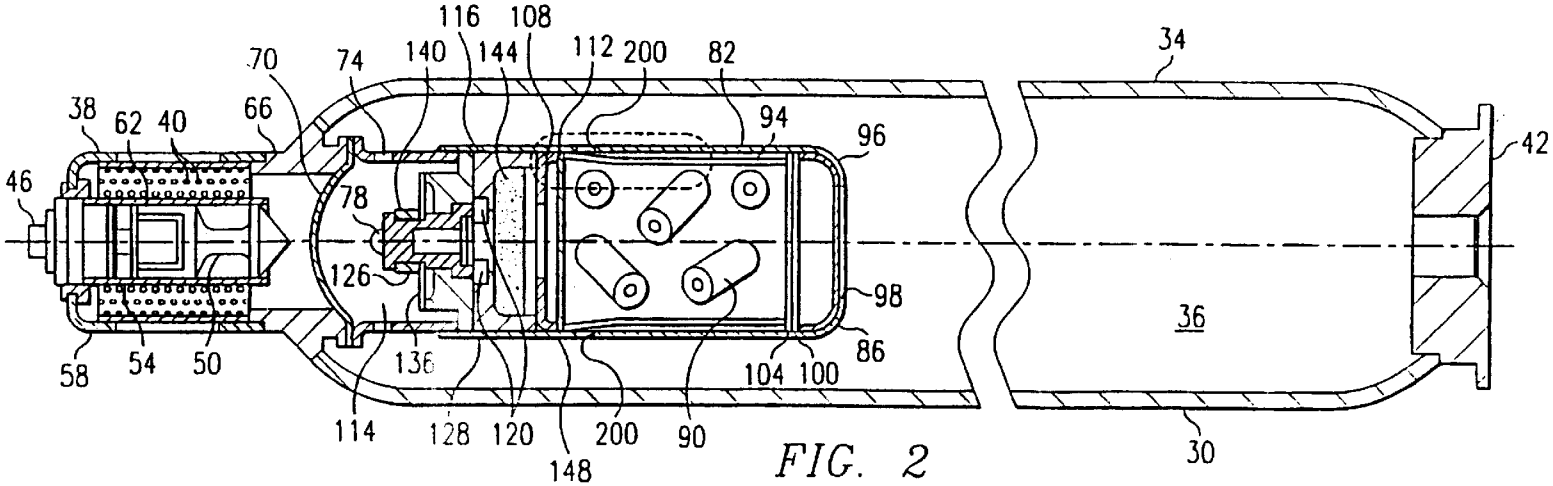
FIG. 2 PRIOR ART

"The inflator 30 illustrated in FIG. 2 is a hybrid inflator and may be used in the inflatable safety system 10 of FIG. 1 in place of the inflator 26. Consequently, the inflator 30 includes a bottle or inflator housing 34 having a pressurized medium 36 that is provided to the air/safety bag 18 (FIG. 1) at the appropriate time, as well as a gas generator 82 that provides propellant gases to augment the flow to the air/safety bag 18 (e.g., by providing heat to expand the pressurized medium 36 and/or generating additional gases). As will be discussed in more detail below, a gun-type propellant (e.g., a high temperature, fuel-rich propellant) may be used for the formulation of the propellant grains 90 positioned in the gas generator 82 and a mixture of at least one inert gas (e.g., argon) and oxygen may be used for the pressurized medium 36.

"The inflator housing 34 and gas generator 82 are interconnected, with the gas generator 82 being positioned inside the inflator housing 34 to reduce the space required for the inflator 30. More specifically, a hollow diffuser 38 is welded to one end of a hollow boss 66 (e.g., having a diameter of about 1.25"). The diffuser 38 has a plurality of rows of discharge holes 40 (e.g., 80 discharge holes 40 each having a diameter of about 0.100") therethrough which provides a "non-thrusting output" from the inflator 30 and a screen 58 is positioned adjacent the discharge holes 40. A closure disk 70 is appropriately positioned within the boss 66 and is welded thereto in order to initially retain the pressurized medium 36 within the inflator housing 34. When release is desired, a projectile 50 having a substantially conically-shaped head is propelled through the closure disk 70. More particularly, the projectile 50 is positioned on the convex side of the closure disk 70 within a barrel 54 and is propelled by the activation of an initiator 46 when an appropriate signal is received from the detector 14 of the inflatable safety system 10 (FIG. 1). A ring 62 is provided to initially retain the projectile 50 in position prior to firing.

"An orifice sleeve 74 is welded to the closure disk 70 and/or the end of the boss 66. The orifice sleeve 74 is hollow and includes a plurality of orifice ports 78 (e.g., four ports 78 each having a diameter of about 0.201") to fluidly interconnect the interior of the inflator housing 34 and the interior of the boss 66 and diffuser 38 when the closure disk 70 is ruptured by the projectile 50. Moreover, the gas generator 82, more specifically the gas generator housing 86, is welded to the orifice sleeve 74 to complete the interconnection of the inflator housing 34 and gas generator 82.

"The gas generator housing 86 contains a plurality of propellant grains 90 which when ignited provide heated propellant combustion product gases for augmenting the flow to the air/safety bag 18 (FIG. 1). The propellant grains 90 are retained within the gas generator housing 86 by a propellant sleeve 94 which is separated from the gas generator inlet nozzle 98 on the end 96 of the gas generator housing 86 by a screen 104 and baffle 100. As will be discussed below, the propellant grains 90 may be formulated from a gun-type propellant. Nonetheless, the grains 90 are substantially cylindrically-shaped with a single hole extending through the central portion thereof. other propellant grain configurations may be appropriate and will depend at least in part on the particular propellant formulation being used.

"A single (or multiple) gas generator inlet nozzle 98 (e.g., a single nozzle 98 having a diameter of about 0.516") is positioned on the end 96 of the gas generator housing 86 and is generally directed away from the closure disk 70. The gas generator housing 86 also includes a plurality of circumferentially spaced outlet or discharge nozzles 200 (e.g., one "row" of four nozzles 200 each having a diameter of about 0.221") on the sidewall of the housing 86. It may be desirable to vary the axial location of these nozzles 200 (they may be generally at the mid-portion of the housing 86), although operations may be enhanced by a location more proximate the outlet. Moreover, it may be desirable to vary the number of nozzles 200. With this configuration of having discharge nozzles 200 on the sidewall of the gas generator housing 86 and an inlet nozzle 98 on the end 96 of the housing 86, during combustion of the propellant grains 90 the pressurized medium 36 is drawn into the gas generator housing 86 through the inlet nozzle 98 and the mixed gases from within the gas generator housing 86 flow out of the housing 86 through the nozzles 200. Specifically, the flow of pressurized medium 36 by the sidewall of the gas generator housing 86 produces a pressure differential which draws pressurized medium 36 into the gas generator housing 86 through the inlet nozzle 98. This significantly improves upon the performance of the inflator 30 at least when certain types propellant gases are produced as will be discussed in more detail below.

"The gas generator 82 includes an ignition assembly 114 for igniting the propellant grains 90 at the appropriate time. The ignition assembly 114 is at least partially positioned within the gas generator housing 86 between the projectile 50 and propellant grains 90 and generally includes an actuation piston 124, and at least one percussion primer 120 and an ignition/booster material 144 which serve as an activator. More particularly, an actuation guide 140 engages an end portion of the orifice sleeve 74 and the interior wall of the gas generator housing 86, the actuation guide 140 thereby functioning at least in part to contain at least a portion of and guide the actuation piston 124 positioned therein. A primer holder 116 engages an end of the actuation guide 140 and houses a plurality of conventional percussion primers 120 which are positioned substantially adjacent to the ignition/booster material 144. The ignition/booster material 144 is typically retained adjacent the primers 120 by a charge cup 148. An example of an appropriate ignition/booster material 144 is an RDX aluminum booster material having a composition of 89% RDX, 11% aluminum powder, with 0.5% hydroxypropylcellulose added. A retainer 108 and baffle 112 are positioned between the primer holder 116 and propellant sleeve 94. In the event that the gas generator housing 86 is attached to the orifice sleeve 74 by crimping instead of welding, the gas generator housing 86 may have a tendency to lengthen during operation. Consequently, in order to maintain a firm interaction of the foregoing components, a wave spring washer (not shown) may be positioned, for instance, between the retainer 108 and the baffle 112.

"The actuation piston 124 is slidably positioned within the actuation guide 140 and includes a continuous rim projecting member 128 which is substantially aligned with the primers 120. As can be appreciated, a plurality of projecting members (not shown), could replace the substantially continuous rim projecting member 128. A belleville washer 136 is positioned between and engages a portion of both the actuation guide 140 and actuation piston 124 (via a spacer 126) to initially maintain the position of the actuation piston 124 away from the primers 120. Consequently, the potential for inadvertent engagement of the actuation piston 124 with the primers 120, which could activate the gas generator 82, is reduced. However, after the projectile 50 passes through the closure disk 70, the energy transferred to the actuation piston 124 by the projectile 50 is sufficient to overcome the belleville washer 136 such that the projecting rim 128 is able to engage the primers 120 with sufficient force to ignite at least one of such primers 120. This in turn causes ignition of the ignition/booster material 144, and thus ignition of the propellant grains 90 results.

"During operation of the gas generator 82, the primers 120 may erode and thereby allow propellant gases generated by combustion of the propellant grains 90 to flow through the primers 120. Any leakage of propellant gases in this manner may adversely affect the consistency of performance of the inflator 30. These gases, however, desirably act upon the actuation piston 124 to move the piston 124 into sealing engagement with the actuation guide 140. This provides a seal for the gas generator housing 90 which substantially limits any leakage of gases therethrough. Therefore, the propellant gases desirably flow through the gas generator nozzle 98.

"Summarizing the operation of the inflator 30, the detector 14 (FIG. 1) sends a signal to the initiator 46 to propel the projectile 50. The projectile 50 initially passes through the closure disk 70 to open the passageway between the inflator housing 34 and air/safety bag 18 (FIG. 1). The projectile 50 continues to advance until it impacts the actuation piston 124 which causes the projecting rim 128 attached thereto to strike at least one of the aligned primers 120. As a result, the ignition/booster charge 144 ignites, which in turn ignites the propellant grain 90. During combustion of the grains 90 within the housing 86, the pressurized medium 36 from the inflator housing 34 is drawn into the gas generator housing 86 through the inlet nozzle 98 positioned on the end 96 of the housing 86. This results from the flow of the pressurized medium 36 by the sidewall of the gas generator housing 86 which produces a pressure differential. This "drawing in" of the pressurized medium 36 promotes mixing of the propellant gases and the pressurized medium 36 within the housing 86, and as will be discussed in more detail below this is particularly desirable when oxygen is included in the pressurized medium 36 to react with propellant gases having a large content of carbon monoxide and hydrogen. Nonetheless, gases are discharged from gas generator housing 86 through the discharge nozzles 200 on the sidewall of the housing 86. As such, the flow to the air/safety bag 18 is desirably augmented (FIG. 1) by mixing of the pressurized medium 36 with the combustion products from the gas generator housing 86.

"As noted above, the hybrid inflator 30 may utilize a gun-type propellant, as the formulation for the propellant grains 90, and a mixture of at least one inert gas and oxygen for the pressurized medium 36 . . . ."

According to the present invention, the gun propellants in the grains 90 are replaced by the plasticizer-free propellants of the present invention.

Finally, U.S. Pat. No. 5,616,883 further describes the hybrid inflator at column 9, line 21 through column 10, line 32, as follows.

"The use of multiple gases for the pressurized medium 36 allows for the use of at least a gun-type propellant formulation for the propellant grains 90. Generally, the pressurized medium 36 is composed of at least one inert gas and oxygen. Appropriate inert oases include argon, nitrogen, helium, and neon, with argon being preferred. The oxygen portion of the pressurized medium is multi-functional. Initially, the reaction of the oxygen with the gaseous combustion products of the gun-type propellant of the propellant grains 90 provides a source of heat which contributes to the expansion of the inert gas. This allows at least in part for a reduction in the amount of propellant which is required for the gas generator 82. Moreover, the reaction of the oxygen with the propellant combustion products also reduces any existing toxicity levels of the propellant gases to acceptable levels. For instance, the oxygen will convert preferably a substantial portion of existing carbon monoxide to carbon dioxide (e.g., convert at least about 85% of CO to $CO_2$) and existing hydrogen to water vapor (e.g., convert at least about 80% of the $H_2$ to $H_2O$), and a substantial portion of the unburned hydrocarbons will be similarly eliminated (e.g., eliminate at least about 75% of the hydrocarbons). As such, the performance of the gas generator 82 as discussed above is significantly improved. That is, the medium 36 and including the oxygen is drawn into the gas generator housing 86 through the inlet nozzle 98 on the end 96 of the housing 86 by the pressure differential produced by the flow of the pressurized medium 36 by the sidewall of the gas generator housing 86 having the discharge nozzles 200 thereon. As a result, there is a mixing of the medium 36 with the CO and hydrogen-rich combustion products of the gas generant which dramatically improves the overall combustion efficiency of the gas generant, the mixing of the combustion products of the gas generant with the oxygen-rich medium 36, and the burning rate of the propellant grains 90. Gases are then drawn out of the discharge nozzles 200 on the sidewall of the housing 86. The above configuration of the gas generator housing 86 thereby greatly improves upon the performance of the inflator 30 (e.g., by promoting the quick and efficient mixing of the oxygen with the propellant gases).

"The amount of the at least one inert gas, on a molar basis, is generally between about 70% and about 90% and the amount of oxygen, on a molar basis, is generally between about 10% and about 30%. Generally, it is desirable to use an amount of oxygen in excess of that based upon theoretical conversions. However, it is also generally desirable to not have more than about 20% (molar) oxygen in the output gas (i.e., the combination of the propellant gases and the pressurized medium).

"The inflator 30 may be assembled in the following manner. Initially, the gas generator 82 is assembled, such as by: 1) inserting the baffle 100 and screen 104 in the gas generator housing 86 adjacent the discharge end 96; 2) inserting the propellant sleeve 94 in the gas generator housing 86; 3) positioning the propellant grains 90 within the propellant sleeve 94; 4) inserting the baffle 112 and retainer 108 in the gas generator housing 86 adjacent the end of the propellant sleeve 94 opposite the discharge end 96 of the generator; 5) inserting the primer holder 116, with the ignition/booster material 144 and charge cup 148, in the gas generator housing 86; and 6) inserting the actuation guide 140, belleville washer 136, and actuation piston 124 into the gas generator housing 86. Thereafter, the various parts are interconnected, such as by welding the gas generator housing 86 to the orifice sleeve 74, by welding the diffuser 38 to the boss 66 after positioning the projectile 50 and initiator 46 in the diffuser 38, welding the closure disk 70 between the boss 66 and orifice sleeve 74, and welding the boss 66 to the inflator housing 34. With the above structure intact, the pressurized medium 36 may be introduced into the inflator housing 34. In this regard and in the case of multiple gases, the argon and oxygen may be separately introduced (e.g., first introduce the argon and/or other inert gases and then the oxygen or vice versa) into the inflator housing 34 through the end plug 42 which is welded to the end of the inflator housing 34, or introduced in the pre-mixed. state."

The general nature of the invention having been set forth, the following examples are presented as specific illustrations thereof. It will be understood that the invention is not limited to these specific examples but is susceptible to various modifications that will be recognized by one of ordinary skill in the art.

EXPERIMENTAL EXAMPLE

To each of two 30 gallon drums was added 48.75 pounds of Nipol AR53L (a polyacrylate polymer having a glass transition temperature of −30° C.; available from Nippon Zeon), 2.20 pounds of Vestenamer 6213 (processing aid from Creanova Inc., a Huls Group Company, 220 Davidson Avenue, P.O. Box 6821, Somerset, N.J. 08875-6821; also available from Struktol Company of America, 201 East Steels Corners Road, P.O. Box 1649, Stow, Ohio 44224-0649), and 66 pounds of tetrahydrofuran (THF). Each drum was allowed to stand undisturbed for 96 hours and then placed on a drum roller and allowed to roll for a minimum of 24 hours. The polymer and processing aid were softened by this procedure. Next, this mixture (97.5 pounds Nipol AR53L, 4.4 pounds of Vestenamer 6213, and 132 pounds of THF) was added to a 150 gallon Days horizontal mixer with sigma blades that had been preheated to 125° F. Then 1.46 pounds of ammonium benzoate (cure catalyst) and 0.65 pounds of Cyanox 2246 (anti-oxidant) were then sprinkled on top of the premix. Finally, 546 pounds of RDX was added on top of the other ingredients and the mixer lid was closed. These ingredients were then mixed for 90 minutes with the blades turning at third speed forward (30 rpm front blade and 20 rpm rear blade). The temperature was maintained at 125° F. during this cycle. The temperature was then lowered to 100° F., the mixer lid was opened, and 40 psi air was blown onto the mix white the blades were turned at third speed forward until enough THF was removed to allow the mix to come to the proper consistency to be extruded. The temperature was then lowered to 80° F., the air was turned off, the mixer lid was closed, and the blades were turned at first speed reverse (14 rpm front blade and 9 rpm rear blade) until the mix temperature reached 80 F. The propellant was then removed from the mixer, extruded through the appropriate dies, and granulated to the correct lengths. Note that the extrusion pressures required may be from 3000 to 9000 psi, preferably 6000 to 9000 psi, and more preferably 7500 to 9000 psi.

This propellant exhibits superior thermal stability properties. These include rigorous temperature resistance testing (both thermal soaking at extremely high temperatures for long periods of time and temperature cycling between two extreme temperatures a large number of times) with no appreciable loss of performance in the airbag inflator.

Obviously, other modifications and variations of the present invention may be a possible in light of the foregoing teachings. It is therefore to be understood that within the scope of the appended claims the invention may be practiced otherwise than as specifically described.

What is claimed is:

1. An improved inflator for an automotive inflatable safety system comprising:

an inflator housing;

a pressurized medium contained within the inflator housing, the pressurized medium consisting essentially of a predetermined amount of an inert gas and a predetermined amount of oxygen;

a gas generator assembly interconnected with the inflator housing and comprising a gas generator housing and at least one gas generator outlet;

a propellant contained within the gas generator housing; and an inflator activation assembly, wherein the pressurized medium is released from the inflator housing and the propellant is ignited to produce the propellant gases;

the improvement comprising: using as the propellant a propellant comprising

A. from 78 to 90 weight percent cyclotrimethylenetrinitramine (RDX); and

B. from 10 to 22 weight percent of a plasticizer-free polymer binder formed by curing a mixture of (1) from about 3 to about 6 weight percent of an polyoctenamer, and (2) from about 94 to about 97 weight percent of an acrylate polymer formed by polymerizing a noncrosslinking monomer of the formula $C(R_1)H{=}CHC(O)OR_2$ when $R_1$ is hydrogen, methyl, or mixtures thereof and $R_2$ is an alkyl group of from 2 to 8 carbon atoms or a mixture of alkyl groups of from 2 to 8 carbon atoms with a crosslinking monomer having two or more double bonds of substantially the same reactivity in the molecule or one double bond and a crosslinking functional group such as an epoxide ring, a hydroxyl group, or a carbonyl group, wherein the crosslinking monomer comprises from 0.01 to 5 weight percent of the monomers with the noncrosslinking monomer comprising the remainder, and wherein the acrylate polymer has a glass transition temperature of −30° C. or lower.

2. The inflator of claim 1 where in the acrylate polymer has an average molecular weight of about 200,000 or more.

3. The inflator of claim 1 wherein the crosslinking functional group is an epoxide ring.

4. The inflator of claim 1 wherein the cyclotrimethylenetrinitramine comprises from 80 to 85 weight percent and the polymer binder comprises from 15 to 20 weight percent of the energetic composite.

5. The inflator of claim 4 wherein the cyclotrimethylenetrinitramine comprises from 82 to 84 weight percent and the polymer binder comprises from 16 to 18 weight percent of the energetic composite.

6. The inflator of claim 1 wherein the polyoctenamer comprises from 4 to 5 and the acrylate polymer comprises from 95 to 96 weight percent of the plasticizer-free polymer binder.

7. The inflator of claim 1 wherein the polymer has a glass transition temperature of from −40° C. to −70° C.

8. The inflator of claim 1 wherein the polyoctenamer has a melting point of from about 28 to about 38° C.

9. The inflator of claim 8 wherein the polyoctenamer has a melting point of about 33° C.

10. The inflator of claim 1 wherein the polyoctenamer has a medium trans content.

11. The inflator of claim 10 wherein the polyoctenamer has a trans content of about 60 percent.

12. The inflator of claim 1 wherein $R_2$ is an alkyl group of from 2 to 4 carbon atoms or a mixture of alkyl groups of from 2 to 4 carbon atoms.

13. The inflator of claim 1 wherein the crosslinking monomer is ethylene glycol diacrylate, ethylene glycol dimethacrylate, butylene glycol diacrylate, butylene glycol dimethacrylate, trimethylolpropane diacrylate, trimethylolpropane dimethacrylate, trimethylolpropane triacrylate, trimethylolpropane trimethacrylate, hexanediol diacrylate, hexanediol dimethacrylate, oligoethylene diacrylate, oligoethylene dimethacrylate, or mixtures thereof.

14. The inflator of claim 1 wherein $R_1$ is hydrogen.

15. The inflator of claim 14 wherein $R_2$ is an alkyl group of from 2 to 4 carbon atoms or a mixture of alkyl groups of from 2 to 4 carbon atoms.

16. The inflator of claim 14 wherein $R_2$ is ethyl, propyl, n-butyl, cyclohexyl, 2-ethylhexyl, or mixtures thereof.

17. The inflator of claim 16 wherein $R_2$ is n-butyl.

18. The inflator of claim 1 wherein $R_1$ is methyl.

19. The inflator of claim 18 wherein $R_2$ is an alkyl group of from 2 to 4 carbon atoms or a mixture of alkyl groups of from 2 to 4 carbon atoms.

20. The inflator of claim 19 wherein $R_2$ is ethyl, butyl, or mixtures thereof.

21. The inflator of claim 20 wherein $R_2$ is n-butyl.

22. A plasticizer-free propellant composition comprising:

A. from 78 to 90 weight percent cyclotrimethylenetrinitramine (RDX); and

B. from 10 to 22 weight percent of a plasticizer-free polymer binder formed by curing a mixture of (1) from about 3 to about 6 weight percent of an polyoctenamer, and (2) from about 94 to about 97 weight percent of an acrylate polymer formed by polymerizing a noncrosslinking monomer of the formula $C(R_1)H{=}CHC(O)OR_2$ when $R_1$ is hydrogen, methyl, or mixtures thereof and $R_2$ is an alkyl group of from 2 to 8 carbon atoms or a mixture of alkyl groups of from 2 to 8 carbon atoms with a crosslinking monomer having two or more double bonds of substantially the same reactivity in the molecule or one double bond and a crosslinking functional group such as an epoxide ring, a hydroxyl group, or a carboxyl group, wherein the crosslinking monomer comprises from 0.01 to 5 weight percent of the monomers with the noncrosslinking monomer comprising the remainder, and wherein the acrylate polymer has a glass transition temperature of −30° C. or lower.

23. The composition of claim 22 where in the acrylate polymer has an average molecular weight of about 200,000 or more.

24. The composition of claim 22 wherein the crosslinking functional group is an epoxide ring.

25. The composition of claim 22 wherein the cyclotrimethylenetrinitramine comprises from 80 to 85 weight percent and the polymer binder comprises from 15 to 20 weight percent of the energetic composite.

26. The composition of claim 25 wherein the cyclotrimethylenetrinitramine comprises from 82 to 84 weight percent and the polymer binder comprises from 16 to 18 weight percent of the energetic composite.

27. The composition of claim 22 wherein the polyoctenamer comprises from 4 to 5 and the acrylate polymer comprises from 95 to 96 weight percent of the plasticizer-free polymer binder.

28. The composition of claim 22 wherein the polymer has a glass transition temperature of from −40° C. to −70° C.

29. The composition of claim 22 wherein the polyoctenamer has a melting point of from about 28 to about 38° C.

30. The composition of claim 29 wherein the polyoctenamer has a melting point of about 33° C.

31. The composition of claim 22 wherein the polyoctenamer has a medium trans content.

32. The composite of claim 31 wherein the polyoctenamer has a trans content of about 60 percent.

33. The composition of claim 22 wherein $R_2$ is an alkyl group of from 2 to 4 carbon atoms or a mixture of alkyl groups of from 2 to 4 carbon atoms.

34. The composition of claim 22 wherein the crosslinking monomer is ethylene glycol diacrylate, ethylene glycol dimethacrylate, butylene glycol diacrylate, butylene glycol dimethacrylate, trimethylolpropane diacrylate, trimethylolpropane dimethacrylate, trimethylolpropane triacrylate, trimethylolpropane trimethacrylate, hexanediol diacrylate, hexanediol dimethacrylate, oligoethylene diacrylate, oligoethylene dimethacrylate, or mixtures thereof.

35. The composition of claim 22 wherein $R_1$ is hydrogen.

36. The composition of claim 35 wherein $R_2$ is an alkyl group of from 2 to 4 carbon atoms or a mixture of alkyl groups of from 2 to 4 carbon atoms.

37. The composition of claim 35 wherein $R_2$ is ethyl, propyl, n-butyl, cyclohexyl, 2-ethylhexyl, or mixtures thereof.

38. The composition of claim 37 wherein $R_2$ is n-butyl.

39. The composition of claim 22 wherein $R_1$ is methyl.

40. The composition of claim 39 wherein $R_2$ is an alkyl group of from 2 to 4 carbon atoms or a mixture of alkyl groups of from 2 to 4 carbon atoms.

41. The composition of claim 40 wherein $R_2$ is ethyl, butyl, or mixtures thereof.

42. The composition of claim 41 wherein $R_2$ is n-butyl.

* * * * *